US006068401A

United States Patent [19]

Ho

[11] Patent Number: 6,068,401

[45] Date of Patent: May 30, 2000

[54] STRETCHABLE BAG

[75] Inventor: Claudia Ho, Taipei Hsien, Taiwan

[73] Assignee: Bridge Elite, Inc., Taipei Hsien, Taiwan

[21] Appl. No.: 09/210,374

[22] Filed: Dec. 14, 1998

[30] Foreign Application Priority Data

Feb. 13, 1998 [TW] Taiwan ..... 86200418 A01

[51] Int. Cl.[7] ..... B65D 30/04

[52] U.S. Cl. ..... 383/97; 150/150; 150/900; 383/66; 383/112

[58] Field of Search ..... 383/43, 118, 112, 383/66, 97; 150/900, 150

[56] References Cited

U.S. PATENT DOCUMENTS

| | | | |
|---|---|---|---|
| 751,748 | 2/1904 | O'Shea | 150/150 |
| 1,527,830 | 2/1925 | Booker | 150/150 |
| 2,071,362 | 2/1937 | Rowe | 383/117 |
| 2,077,438 | 4/1937 | Rowe | 383/117 |
| 2,213,290 | 9/1940 | Rowe | 383/117 |
| 2,370,419 | 2/1945 | Ray | 383/117 |
| 2,416,732 | 3/1947 | Barnett | 150/150 |
| 2,434,892 | 1/1948 | Ulm | 383/117 |
| 2,667,906 | 2/1954 | Stiller | 150/150 |
| 2,737,339 | 3/1956 | Doyle | 383/117 |
| 2,790,592 | 4/1957 | Doyle et al. | 383/117 |
| 2,909,203 | 10/1959 | Reaves | 150/150 |
| 2,952,397 | 9/1960 | Doyle | 383/117 |
| 3,353,579 | 11/1967 | Bechter et al. | 150/150 |
| 4,012,050 | 3/1977 | Miller | 280/11.38 |
| 4,626,457 | 12/1986 | Willie | 150/150 |
| 4,739,877 | 4/1988 | Olson | 150/900 |
| 5,244,023 | 9/1993 | Spies | 150/900 |

*Primary Examiner*—Stephen P. Garbe
*Attorney, Agent, or Firm*—Dougherty & Troxell

[57] ABSTRACT

A stretchable bag includes an enclosed bag body made of a bag fabric. The bag body has an opening at one place thereof. The bag fabric includes an elastic layer and a surface layer adhered thereto. The elastic layer is preferably formed from foamed polybutylene gum or styrene or butadiene gum. The surface layer being preferably formed a fabric of nylon yarns or polyester yarns. The bag body has an elasticity that enables the opening to be stretched open to facilitate placement of articles into the bag body and to contract thereafter to ensure that the contents of the bag body do not fall out. At least one side of the bag fabric is provided with an ornamental layer to enhance visual effects.

4 Claims, 3 Drawing Sheets

STRETCHABLE BAG

BACKGROUND OF THE INVENTION (a) Field of the Invention

The present invention relates generally to a stretchable bag, more particularly to a stretchable bag adapted for receiving articles and having an opening that allows opening or closure thereof.

(b) Description of the Prior Art

People may carry with them sundry articles when going out. And how to store the various small articles in a bag is a problem. However, as conventional bags have their particular functions and are made of materials, such as fiber or leather (genuine or imitation), that do not allow stretching, their storage capacity is very limited.

Small items, such as keys and coins, that are frequently used are inconvenient to find if they are just put in the pocket or in a handbag, it is desirable to have a stretchable bag to keep them in a neat manner.

SUMMARY OF THE INVENTION

Therefore, a primary object of the present invention is to provide a stretchable bag that is compact in appearance but can be stretched to hold a number of articles, and that has an opening that can be stretched to allow placement of articles and that can contract thereafter to prevent the articles from falling out.

According to the present invention, a stretchable bag includes an enclosed bag body made of a bag fabric. The bag body has an opening at one place thereof. The bag fabric includes an elastic layer and a surface layer adhered thereto. The elastic layer is preferably formed from foamed polybutylene gum or styrene or butadiene gum. The surface layer being preferably formed a fabric of nylon yarns or polyester yarns. The bag body has an elasticity that enables the opening to be stretched open to facilitate placement of articles into the bag body and to contract thereafter to ensure that the contents of the bag body do not fall out. At least one side of the bag fabric is provided with an ornamental layer to enhance visual effects.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 2:
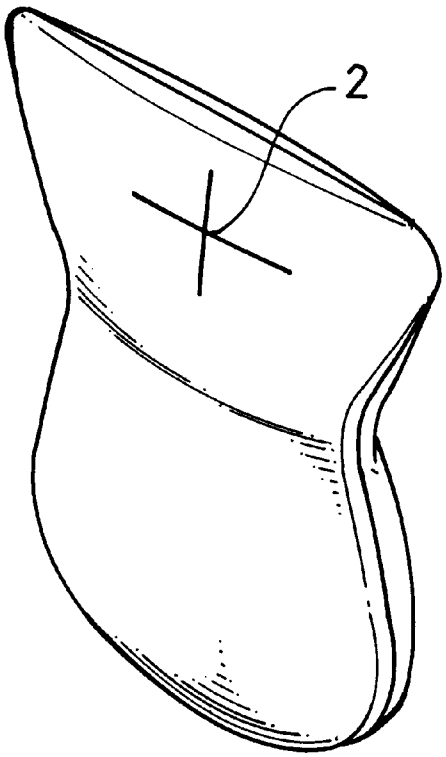
FIG. 2 is a rear elevation of the first preferred embodiment.
Figure 1:
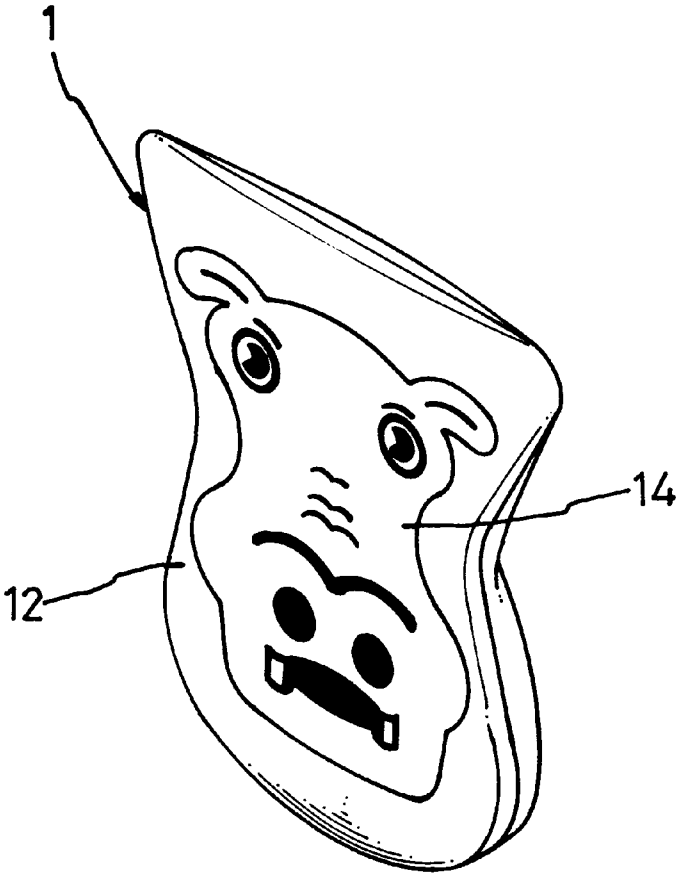
FIG. 1 is a front elevation of a first preferred embodiment of the present invention.
Figure 3:
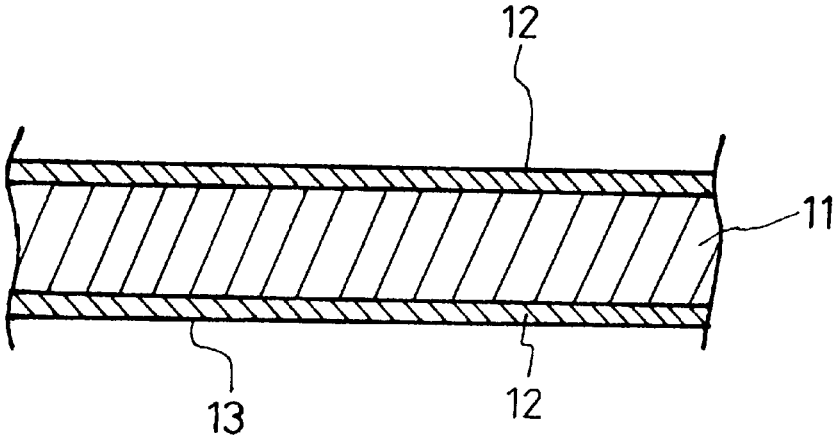
FIG. 3 is a sectional view of the first preferred embodiment.

As shown in FIGS. 1 to 3, a stretchable bag according to the present invention includes an enclosed bag body 1 formed by a bag fabric sewn to define an enclosed interior space for receiving articles, the bag body 1 having an opening 2 formed in a suitable position.

As mentioned above, conventional bags are generally made of fiber or leather (genuine or imitation) materials. The interior receiving space is not elastic due to the bag material and the size of which is limited to the space enclosed by the bag. In the present invention, the bag fabric 1 includes an elastic layer 11, a surface layer 12 adhered to an upper side of the elastic layer 11, and a bottom lining 13 attached to a lower side of the elastic layer 11.

The elastic layer 11 is formed from a foam material having stretching elasticity. Experiments show that foamed polybutylene gum or foamed styrene or butadiene gum is preferred.

The surface layer 12 and the bottom lining 13 are fibrous fabrics that match the elastic layer 11 to achieve elastic effects. Hence, they are preferably formed from nylon cloth or polyester cloth woven from nylon yarns or polyester yarns.

The surface layer 12 and the bottom lining 13 are adhered to the elastic layer 11 in a conventional way. For instance, an adhesive or glue may be applied and roller pressing may be utilized to achieve firm attachment.

The opening 2 on one side of the bag body 1 may be a slit that is linear or that has the shape of a cross, star, circle, etc. In the first preferred embodiment of the present invention, the opening 2 is cross-shaped. Certainly, the opening 2 may also be partially hollowed out.

Furthermore, in order to enhance the visual effects, one side of the bag of the present invention may be provided with an ornamental layer 14. The ornamental layer 14 may be formed by adhering stickers or using transfer printing, printing, or other conventional methods. The shape of the bag can further be dictated by the shape of the decoration on the ornamental layer 14. In the first preferred embodiment, the bag is in the shape of a hippopotamus. Certainly, the bag can have any desired ornamental shape.

Figure 4:
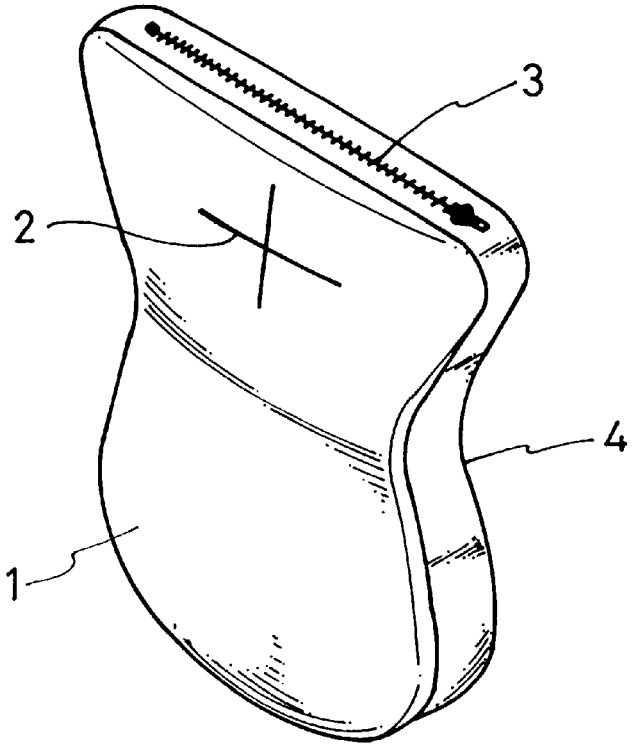
FIG. 4 is a perspective view of a second preferred embodiment.

Referring to FIG. 4, which shows the second preferred embodiment of the present invention, the present invention is adapted for use on wallets. In this embodiment, the bag is additionally provided with a closure layer 4 at the end opposite to the opening 2. One end of the closure 4 is provided with a closing device 3. In this way, the bag of the present invention confines two receiving spaces for receiving articles. As for the ornamental layer 14, it can be provided on an outer surface of the closure layer 4. The closing device 3 may be a conventional zipper or hook-and-loop tapes or other equivalent means.

In practice, the present invention may have various changes. For instances, the opening 2 and the ornamental layer 14 can be formed on the same surface or opposite surfaces of the bag. When they are formed on the same surface, the opening 2 is disposed at a specific portion of the ornament on the ornamental layer 14, for instance, at the mouth portion of an animal ornament, to achieve a funny visual effect. Conversely, when they are disposed on opposite surfaces, the design of the ornament can be kept intact.

Figure 5:
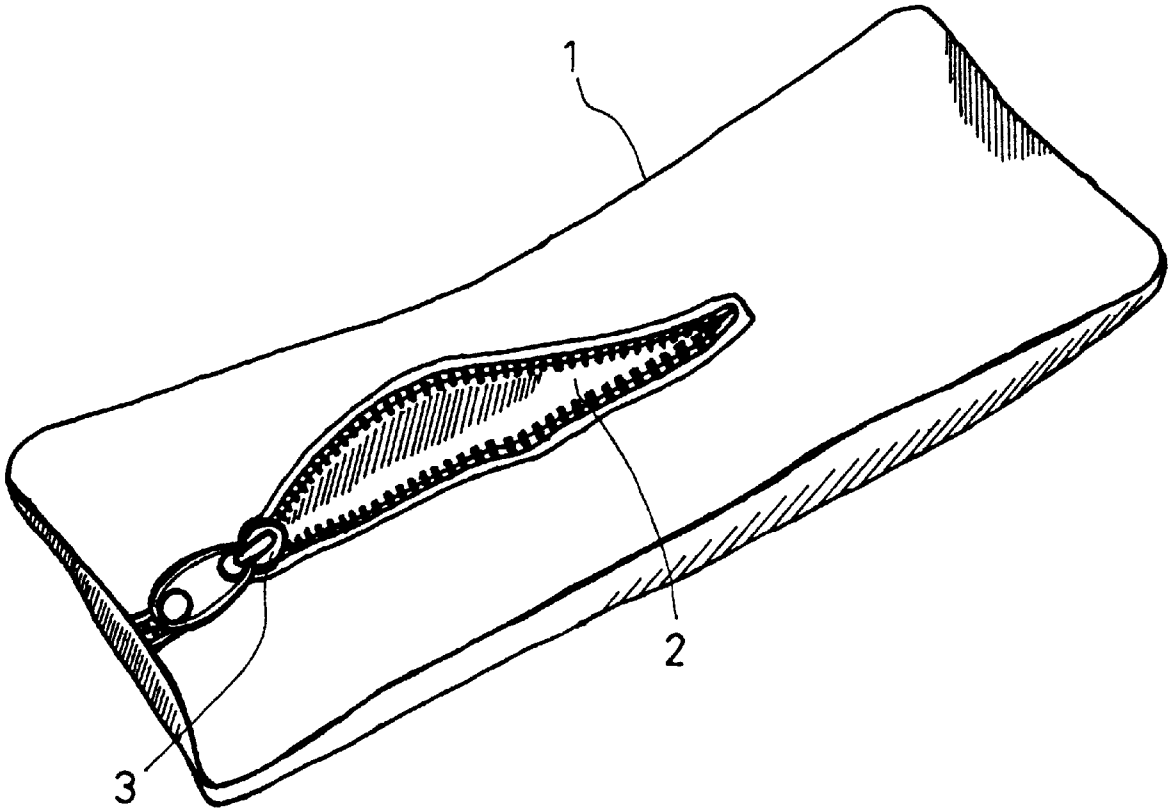
FIG. 5 is a perspective view of a third preferred embodiment.

Reference is made to FIG. 5, which shows the third preferred embodiment of the present invention. This embodiment is adapted for use in a stationery bag, such as a pencil bag. In this embodiment, the closure device 3 is provided on the opening 2. Therefore, in use, the closure device 3 allows or closes access to the interior of the bag for placement or removal of articles. Through actual practice, the bag of the present invention has a tensile strength at least over 8 kg/cm, and a stretchability as high as over 500%. Therefore, the fabric bag 1 can have a larger receiving capacity in use.

As the bag body 1 of the present invention has excellent elasticity, the opening 2 can be very small in size. The opening 2 can be stretched to allow easy access to the interior of the fabric bag 1. After placement of articles, the opening 2 will resume its original size to prevent the contents of the bag from falling out. Furthermore, the bag of the present invention is resistant to water, light in weight, resistant to stretching, and durable. In addition, the present invention is inexpensive to manufacture.

Although the present invention has been illustrated and described with reference to the preferred embodiment thereof, it should be understood that it is in no way limited to the details of such embodiment but is capable of numerous modifications within the scope of the appended claims.

What is claimed is:

1. A stretchable bag comprising:

a) a bag body having fabric material defining an enclosed bag body, the fabric material comprising: a first layer having inner and outer facing surfaces, the first layer selected from the group consisting of foamed polybutylene gum, foamed styrene and foamed butadiene gum; a second layer bonded to the outer facing surface of the first layer; and a third layer bonded to the inner facing surface of the first layer, each of the second and third layers comprising the same material selected from the group consisting of nylon cloth and polyester cloth, whereby the bag body has a stretchability of at least 500% and a tensile strength of at least 8 kg/cm;

b) a stretchable opening formed in the bag body; and c) a releasable closure device located on the bag body adjacent to the stretchable opening to close or open the opening.

2. The stretchable bag of claim 1 wherein the releasable closure device comprises a zipper.

3. The stretchable bag of claim 1 wherein the opening is formed in a side of the bag body and further comprising an ornamental design applied to the bag body on its same side as the opening.

4. The stretchable bag of claim 1 wherein the opening is formed in a first side of the bag body and further comprising an ornamental design applied to a second side of the bag body opposite the first side.

* * * * *